US005945183A

United States Patent [19]

Johnson

[11] Patent Number: 5,945,183

[45] Date of Patent: Aug. 31, 1999

[54] SLEEVE LABEL WITH UV CURABLE COATING AND PROCESS FOR MAKING THE SAME

[76] Inventor: David E. Johnson, 606 Lumpkin Campground Rd., Dawsonville, Ga. 30534

[21] Appl. No.: 08/702,283

[22] Filed: Aug. 23, 1996

[51] Int. Cl.[6] ..... G09F 3/02

[52] U.S. Cl. ..... 428/34.9; 428/35.2; 428/36.9; 428/36.91; 428/192; 428/195; 428/200; 428/913; 40/310

[58] Field of Search ..... 428/35.7, 36.9, 428/36.91, 35.2, 40.1, 43, 192, 200, 34.9, 195, 913; 40/310

[56] References Cited

U.S. PATENT DOCUMENTS

| | | | |
|---|---|---|---|
| 3,989,609 | 11/1976 | Brack | 522/8 |
| 4,281,040 | 7/1981 | Santiago | 428/36.5 |
| 4,585,679 | 4/1986 | Karabedian | 428/36.5 |
| 4,587,158 | 5/1986 | Ewing | 428/219 |
| 4,626,455 | 12/1986 | Karabedian | 428/36.5 |
| 5,079,057 | 1/1992 | Heider | 428/36.5 |
| 5,368,891 | 11/1994 | Sagara et al. | 427/258 |
| 5,384,160 | 1/1995 | Frazzitta | 427/288 |
| 5,422,152 | 6/1995 | Langeland et al. | 428/36.91 |
| 5,464,254 | 11/1995 | Campbell et al. | 283/109 |
| 5,492,733 | 2/1996 | D'Anna et al. | 427/517 |
| 5,518,762 | 5/1996 | Soltysiak et al. | 427/208 |

*Primary Examiner*—Rena L. Dye
*Attorney, Agent, or Firm*—Kenneth S. Watkins, Jr.

[57] ABSTRACT

A sleeve label having an open top and bottom for sleeving a product such as a bottle, jug, or drum. The sleeve label comprises a plastic film printed on one surface with a solvent base ink. The printed surface is coated with a UV curable coating, covering the printed side including the solvent base ink. Upon curing with UV energy, the coating protects the ink from smearing in contact with solvents. The coating also protects the ink from mechanical damage such as scratching or abrasion. The UV curable coating may be applied to the film with a flexographic print station, or other roll or blade coaters. The coating may be of the free radical acrylate or cationic epoxy types.

4 Claims, 3 Drawing Sheets

SLEEVE LABEL WITH UV CURABLE COATING AND PROCESS FOR MAKING THE SAME

BACKGROUND OF THE INVENTION

The present invention relates to stretchable sleeve labels used in labeling containers and, more particularly, with printed sleeve labels with a protective coating over the printing.

Sleeve labels have replaced adhesive labels on many products such as plastic jugs, bottles, drums and propane/butane cylinders. Sleeve labels are made from plastic films printed and formed into sleeves which can be placed over the container. They differ from "shrink wrap" packaging in that sleeve labels are stretched and placed over the product or container as a sleeve. When released, the sleeve relaxes toward a memory condition, securing the sleeve to the product without heat or chemical treatment. Sleeve labels can be easily attached and removed from the container without the use of adhesives. Sleeve labels promote recycling of containers since the old labels can be removed quickly without the residue of adhesives. Printing, fabrication, insertion, and removal are easily automated, resulting in low cost and good product flexibility. The printing methods used in sleeve labels allow high quality printing and graphics.

A common problem with sleeve labels is smearing of the inks printed on the film surface. Another problem is mechanical damage such as scuffing, scratching or abrading the printed surface of the sleeve label, degrading the appearance of the label. These problems are especially apparent when solvent containing liquids are contained in the packaging. The packaging is often heavy, increasing the mechanical stresses and loads during shipping and handling. Reversing the printing surface so that the printed surface is on the inside of the sleeve protects the printed surface from some mechanical damage. However, smearing still occurs due to solvent spillage from the product or from other sources. This is especially a problem when solvent base inks are used in the printing as they are readily dissolved by many solvents.

In the past, ultra violet (UV) curable inks have been used. The UV curable inks are resistant to most solvents, but are expensive and complicate ink inventory requirements. They also do not provide mechanical protection of the ink surfaces.

A second solution used in the past is to laminate a second plastic film over the printed surface. This method allows use of solvent base inks and provides protection from solvents as well as mechanical protection. However, laminating is a complicated and expensive process limiting its use.

SUMMARY OF THE INVENTION

Therefore an object of the present invention is to provide a stretchable sleeve label with a coating which can be easily applied over the printed surface of the sleeve.

A further object of the present invention is to provide a sleeve label with a protective coating which is can be used over solvent base inks.

A further object of the present invention is to provide a sleeve label with a protective coating which prevents smearing of the ink and provides protection of the printed surface from mechanical damage such as scratching and scuffing.

A further object of the present invention is to provide a sleeve label with a protective coating which is low in cost.

Yet another object of the present invention is to provide a sleeve label with a protective coating which can be manufactured with existing equipment and requires minimum modifications.

The stretchable sleeve label of the present invention comprises a plastic film printed on at least one surface with a solvent base ink. A UV curable coating is applied over the printed surface so that the coating covers the entire surface including the solvent base ink. The UV curable coating may be free radical acrylate or cationic epoxy base coatings. The UV curable coating is cured by irradiating the coating with UV energy. The sleeve label comprises a heat seal such as a heat slit seal to form the sleeve.

In the preferred embodiment, the sleeve label is made by printing a surface of a polyethylene film web with solvent base inks using a flexographic press. The ink is dried in a dryer such as an overhead dryer. The printed surface of the web is coated with a UV curable coating or lacquer so that the coating covers the complete printed surface of the film including the inked and non-inked portions. The coating is set with a UV energy source such as a UV lamp. The web is then folded on a longitudinal axis and the edges joined with a heat seal to form a seam. The resulting sleeve is perforated and separated to form sleeve labels.

BRIEF DESCRIPTION OF THE DRAWINGS

These and other features, aspects and advantages of the present invention will become better understood with regard to the following description, appended claims and accompanying drawings where:

DESCRIPTION OF THE PREFERRED EMBODIMENTS

The following is a description of the preferred embodiments of a printed sleeve label with UV curable coating to prevent smearing and scratching of the printed surface.

Figure 1:
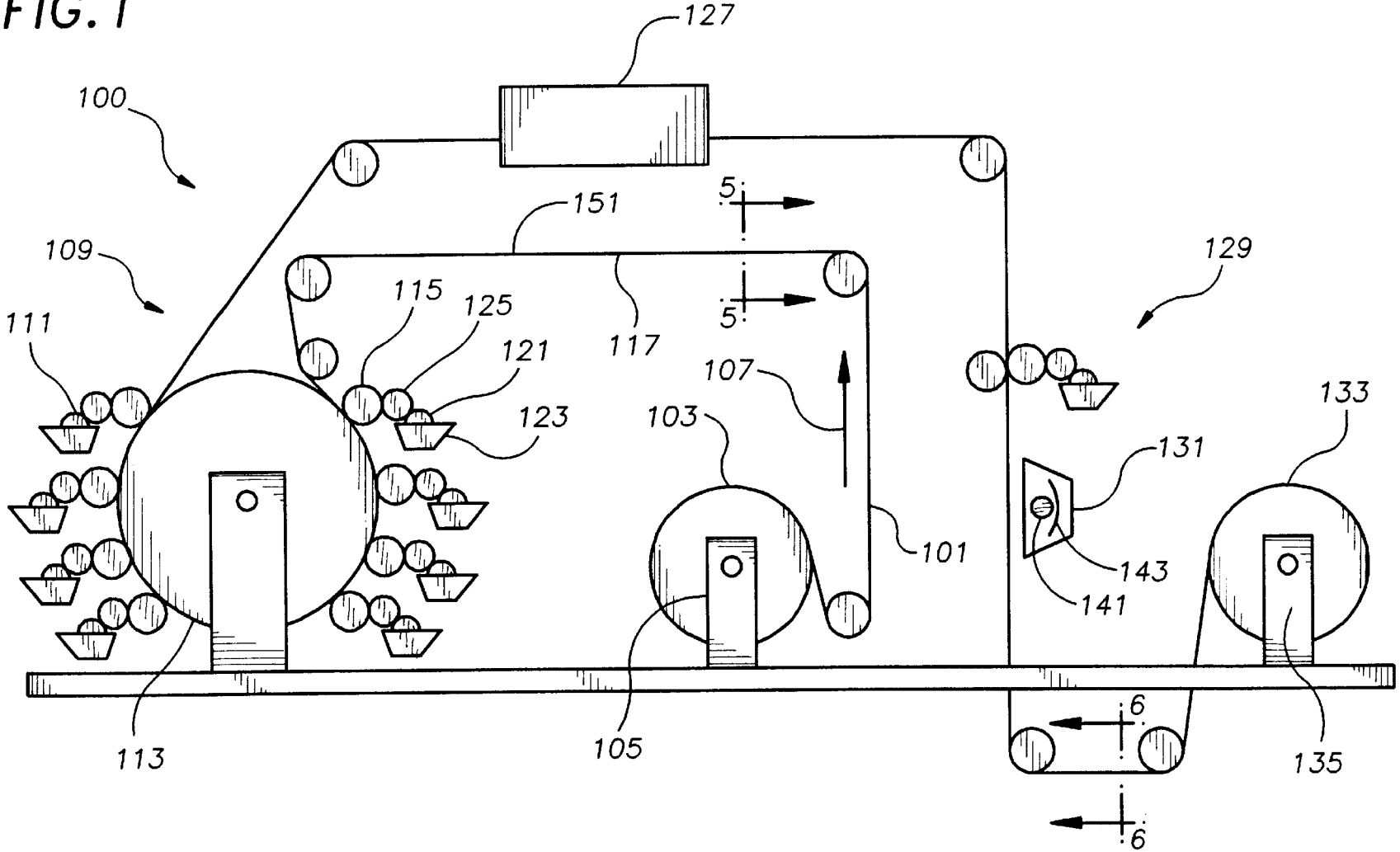
FIG. 1 is a side elevation schematic drawing of a printing and coating station for a plastic film web.

FIG. 1 is a elevation drawing of embodiment 100 of a printing and coating station for making the coated webstock for the present invention. Web 101 is unwound from web roll 103 supported in unwind stand 105. Web 101 is a plastic film 0.001 to 0.005 inches thick suitable for making stretch sleeve labels. The film may be extruded poly olefin resin. In the preferred embodiment, a low density polyethylene (LDPE) film is used. The surface of the film may be treated with an electrical discharge treatment such as corona treatment to improve ink and coating adhesion. Web 101 is a continuous web fed in direction 107 to printing unit 109.

In the preferred embodiment, printing unit 109 is a flexographic printing unit comprising several flexographic printing stations 111 and central impression cylinder 113. Plate cylinder 115 prints an impression on web surface 117.

Central impression cylinder 113 supports web 101 during printing. Rubber roll 121 transfers ink (not shown) in pan 123 to anilox or metering roll 125. Metering roll 125 meters the desired amount of ink to plate cylinder 115. The ink used in printing unit 109 is solvent base ink such as polyamid ink. Overhead dryer 127 utilizes thermal energy to dry the solvent base ink on web surface 117. Gas or electric dryers may be used for this purpose.

Coating station 129 applies a thin layer of UV curable coating (not shown) on web surface 117 over the printing. UV curing station 131 cures the UV coating by irradiating web surface 117 with UV energy. Web 101 having been printed and coated is wound on roll 133 and supported by wind stand 135.

Figure 2:
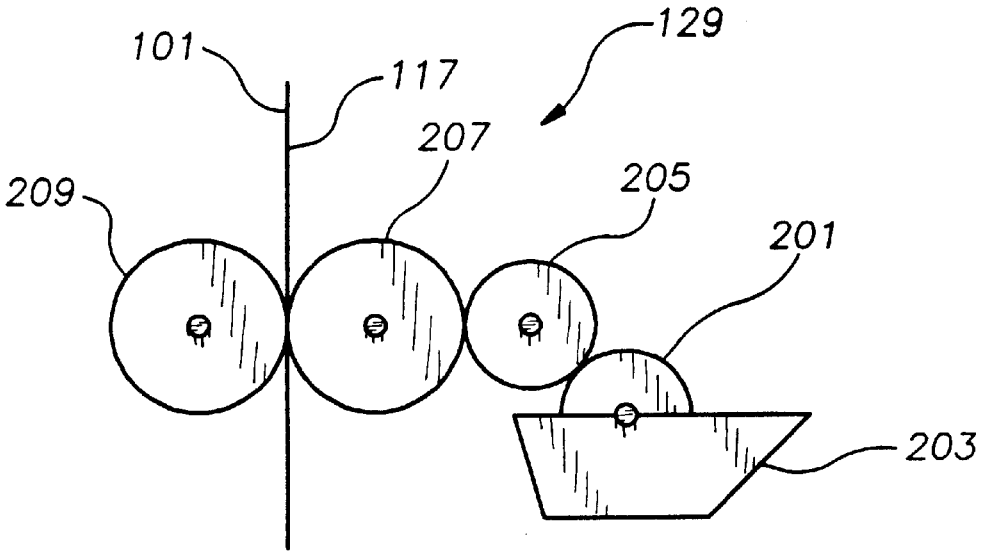
FIG. 2 is a detail side elevation schematic drawing of a coating station for the plastic film web.

FIG. 2 is a detailed schematic elevation drawing of coating station 129. Rubber roll 201 transfers UV curable coating (not shown) from pan 203 to metering roll 205. Metering roll 205 meters the desired amount of coating to plate cylinder 207. Plate cylinder 207 transfers the coating to surface 117 of web 101. Impression cylinder 209 supports web 101 during the coating operation.

The UV curable coating must be compatible with the solvent base inks. The coating must also be resistant to solvents which may come into contact with the coating. Coatings found satisfactory and meet the requirements include commercially available free radical acrylate coatings and cationic epoxy coatings.

The cationic epoxy UV coatings are an essentially 100% solids coating comprising a blend of cycloaliphatic epoxides, polyols, epoxidized ester, alpha olefin oxide and onium salt photoinitiators that, when exposed to the proper wavelength of UV light for a predetermined amount of time, will undergo photolysis and polymerize to a solid, dry and tack-free state. UV curing station 129 comprises UV lamp 141 of FIG. 1 which emits the desired wavelength of UV energy. Reflector 143 reflects the UV energy to web surface 117.

The solvent base ink should be waxless to allow good adhesion of the coating. The ink should also be free of components which interfere with the photolysis process. Solvent base inks that are satisfactory and commercially available include those comprising cellulose nitrate resin dissolved in a blend of various alcohols and low boiling point esters; plasticized with phosphate and other polymeric plasticizers and colored with organic and inorganic pigments.

Figure 3:
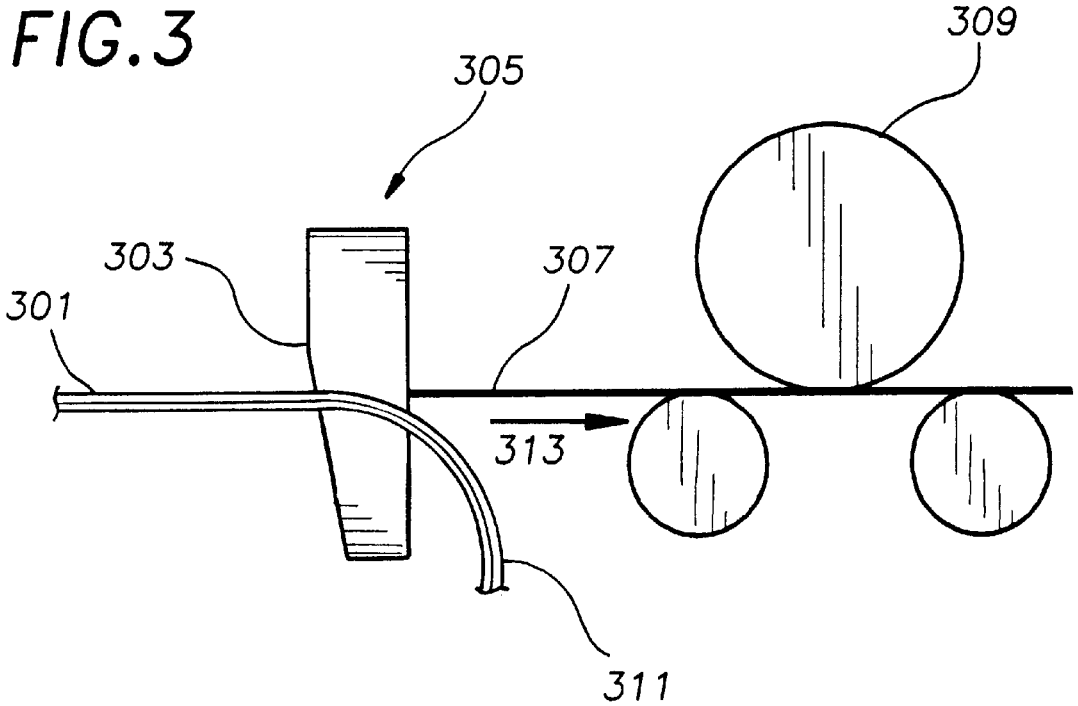
FIG. 3 is a detail schematic of a hot slit seal knife for slit sealing the film to form a sleeve, and a perforation roll for perforating the film.

After printing and coating, web 101 is folded and heat sealed to produce the stretch sleeve labels. Web 101 from roll 133 is folded longitudinally with the edges of unprinted surface 151 adjacent to each other. The folded web (301 of FIG. 3) is slit sealed longitudinally along the folded web by heated blade 303 of slit seal station 305, forming a continuous sleeve 307. Continuous sleeve 307 is perforated transversely by perforation cylinder 309 and wound on a finish roll similar to roll 133 of wind stand 135. Trim tail 311 is collected for recycling. Individual sleeves are separated at the perforations and stretched over the product.

Figure 4:
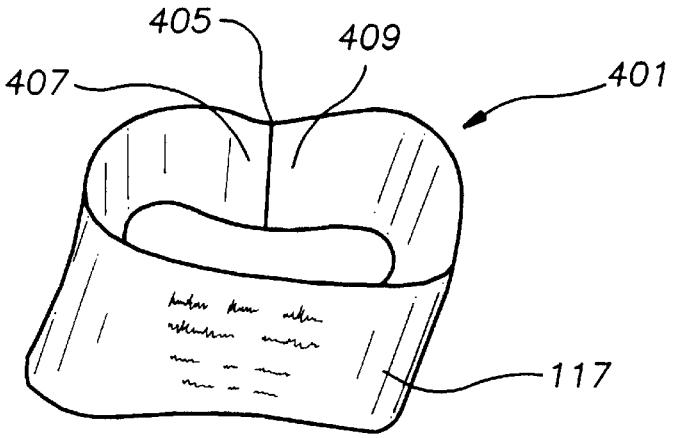
FIG. 4 is a perspective drawing of a printed and coated sleeve label.

FIG. 4 shows a completed sleeve label 401 with printed and coated web surface 117 on the outside of sleeve label 401. Heat slit seal 405 seals portions 407 and 409 forming the sleeve with an open top and open bottom. Portions 407 and 409 represent the portions of web 101 near the web edges before slit sealing. In an alternative embodiment, web 101 may be folded with the edges of printed side (117 of FIG. 1) together. The resulting sleeve will have the printed side 117 on the inside of the sleeve.

Figure 5:
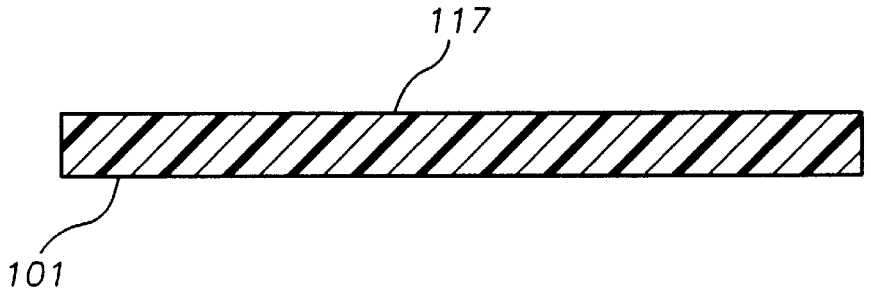
FIG. 5 is a cross section of the film web taken along lines 5—5 of FIG. 1.

FIG. 5 is a cross section of film web 101 taken at 5—5 of FIG. 1. Surface 117 is treated with a corona discharge to roughen surface 117 and improve adhesion of the inks and coating.

Figure 6:
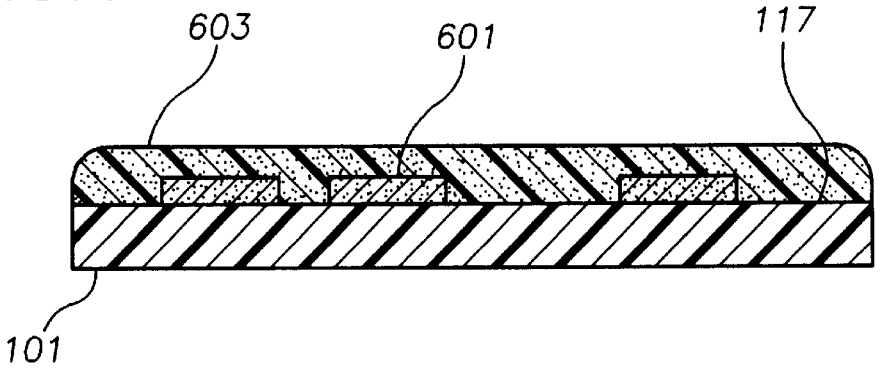
FIG. 6 is a cross section of the printed and coated film web taken along lines 6—6 of FIG. 1.

FIG. 6 is a cross section of the printed and coated film web 101 taken at lines 6—6 of FIG. 1. Solvent base ink 601 is printed on surface 117 of polyethylene web 101. UV curable coating 603 covers surface 117 and ink 601. Solvent base ink 601 is waxless to allow better adhesion of coating 603 to ink 601. Coating 603 thickness may be controlled by selection of metering roll characteristics such as line screen, cell volume, and cell depth. Desired coating thickness is 2–15 microns. Other coating methods such as blade coating may be used to apply the coating.

EXAMPLE 1

A polyethylene film having a thickness of 0.002" (2 mills) and web width of 21.5" was corona treated at 38 dynes/cm. The web was printed in 3 colors with a flexographic press. Inks used were solvent base, waxless, CRODATHANE®, available from Croda Inks Corporation. The ink was dried in an overhead dryer at 150 degrees Fahrenheit.

The printed web was coated with a free radical acrylate coating, DYNACURE A® available from Croda Inks Corporation. The coating was applied in a flexographic coating station. The metering roll was 250 cell/inch line screen. Cell volume was 6.5 billion cubic microns/sq. in. Cell depth was 25 microns. Measured coating thickness was 4 microns. Web speed was 120–150 feet per minute. UV lamp power was 160 watts/cm at a wavelength of 250–450 nanometers.

The coated film was converted by folding the film longitudinally on a web folding device, slit seamed using a hot slit seam knife and perforated to form the completed sleeve labels.

EXAMPLE 2

A polyethylene film having a thickness of 0.002" (2 mills) and web width of 21.5" was corona treated at 38 dynes/cm. The web was printed in one color with a flexographic press. Ink used was a solvent base, waxless, CRODATHANE®, available from Croda Inks Corporation. The ink was dried in an overhead dryer at 150 degrees Fahrenheit.

The printed web was coated with a cationic epoxy coating, DYNACURE E® available from Croda Inks Corporation. The coating was applied in a flexographic coating station. The metering roll was 250 cell/inch. Cell volume was 6.5 billion cubic microns/sq. in. Cell depth was 25 microns. Measured coating thickness was 4 microns. Web speed was 120–150 feet per minute. UV lamp power was 160 watts/cm at a wavelength of 250–450 nanometers.

The coated film was converted by folding the web longitudinally on a folding device, slit seamed using a hot slit seam knife and perforated to form the completed sleeve labels.

Accordingly the reader will see that the sleeve label with UV curable coating provides a sleeve label with a coating which protects the print from solvents and mechanical damage. The device provides the following additional advantages:

- The sleeve label can be made on existing equipment with minimal modification;
- The cost of the sleeve labels is low compared with laminated sleeves; and
- Solvent base inks can be used for printing.

Although the description above contains many specifications, these should not be construed as limiting the scope of the invention but as merely providing illustrations of some of the presently preferred embodiments of this invention. For example, blade coaters may be used to apply the coating. Multiple coating may be applied over the printed surface or, alternatively, both surfaces may be coated. Thus the scope of the invention should be determined by the appended claims and their legal equivalents, rather than by the examples given.

I claim:

1. A stretchable sleeve label for labeling a product, the sleeve label having an open top and an open bottom, the sleeve label comprising:

a substrate of extruded polyolefin resin film, the film being stretchable and comprising a memory condition, the sleeve label comprising a heat seal extending longitudinally along the film from the open top to the open bottom;

a solvent base ink applied to a first surface of the film wherein the ink comprises cellulose nitrate resin; and a UV cured coating on the first surface of the film over the solvent base ink, whereby the UV cured coating protects the ink from smearing when solvents are in contact with the sleeve label.

2. The sleeve label of claim 1 wherein the substrate comprises a low density polyethylene film, and the first surface of the polyethylene film is treated with an electrical corona discharge treatment whereby adhesion of the solvent base ink and UV cured coating is improved.

3. The sleeve label of claim 1 wherein the UV cured coating comprises a free radical acrylate coating.

4. The sleeve label of claim 1 wherein the UV cured coating comprises a cationic epoxy coating.

* * * * *